US007243661B2

(12) United States Patent
Lun et al.

(10) Patent No.: US 7,243,661 B2
(45) Date of Patent: Jul. 17, 2007

(54) HAIR STYLING APPLIANCE

(75) Inventors: Herbert Lun, Hong Kong (HK); Michael Cafaro, El Paso, TX (US)

(73) Assignee: Helen of Troy Limited, Bridgetown (BB)

( * ) Notice: Subject to any disclaimer, the term of this patent is extended or adjusted under 35 U.S.C. 154(b) by 78 days.

(21) Appl. No.: 11/031,990

(22) Filed: Jan. 7, 2005

(65) Prior Publication Data

US 2006/0150996 A1 Jul. 13, 2006

(51) Int. Cl.
*A45D 2/40* (2006.01)

(52) U.S. Cl. ..... 132/224; 219/225

(58) Field of Classification Search ..... 132/224, 132/225, 229, 227, 232; 219/225; D28/35, D28/37, 38

See application file for complete search history.

(56) References Cited

U.S. PATENT DOCUMENTS 1,510,359 A * 9/1924 Van Gale ..... 132/233
5,091,629 A * 2/1992 McGee ..... 219/222
5,785,064 A * 7/1998 Simpson ..... 132/226
5,957,140 A * 9/1999 McGee ..... 132/224
6,223,753 B1 * 5/2001 Lo ..... 132/224
D450,154 S * 11/2001 Amante ..... D28/35
6,615,847 B1 * 9/2003 Hagelstam ..... 132/225
6,627,852 B1 * 9/2003 Savone ..... 219/225
2004/0089317 A1 * 5/2004 McCambridge et al. .... 132/232
2005/0081876 A1 * 4/2005 Choi ..... 132/224

* cited by examiner

*Primary Examiner*—Todd E. Manahan
*Assistant Examiner*—Rachel A. Running
(74) *Attorney, Agent, or Firm*—Vinson & Elkins LLP

(57) ABSTRACT

A hair styling device includes two blades that are hinged together at one end thereof and provide heated plates at the opposite ends for styling hair. The blades and heated plates provide a fine straight edge at one side and a rounded edge at the opposing side.

7 Claims, 4 Drawing Sheets

HAIR STYLING APPLIANCE

BACKGROUND OF THE INVENTION

Various heated appliances are available for the drying and styling of hair including those that blow hot air onto the hair and those that contact the hair with a heated surface, such as hot curlers, curling irons and flat irons or flat straighteners. The styles that can be achieved by a heated surface device is limited by the shape of the surface and typically a different device is needed for each aspect of a hair style.

There have been previous appliances that combine straightening and curling functions in a single appliance either by providing detachable and interchangeable styling tools to a single barrel or by attempting to combine more than one shape on a single device. One such attempt is described in U.S. Pat. No. 5,957,140 in which the blades are barrel and channel shaped in the inner portion (toward the hinge) and become flat in the end portions. Use of such a device could be inconvenient as a user would have to be careful not to place hair in the transition zone between the curved and flat portions of the blades. Such a user would also need to be very careful when using the inner, curling portion, not to touch and thus burn the hair or scalp with the protruding flat portions. A further disadvantage of such a device is that is has no internal heating mechanism and has to be heated by an external heating source so the temperature is uncontrolled and would decrease during styling.

SUMMARY

The present disclosure may be described in certain embodiments as a hair styling appliance, or a hair styling flat iron having dual edged plates, or plates with opposing edges of different shapes. It is known that the plates of a flat iron appliance are heated and that applying the heated plates to the scalp hair of a user is useful for styling the hair. The plates of the disclosed devices may be formed of any suitable material such as aluminum or steel and may be anodized, plated or coated with any appropriate material. The plates may also be formed of materials such as ceramic, glass, or precious stone such as jade. The present disclosure provides such appliances in which the heated plates are designed to be more versatile and to provide the opportunity to create unique hair styles. For example, in preferred embodiments, the opposing edges on one side of the blades are rounded and the opposite edges taper to a fine straight edge. The edges are thus of different shapes and also provide different functions. A rounded edge is designed to allow a user to create various flip styles and curling styles for the end of a lock of hair. The fine straight edge design allows the user to place the heated plate very close to the root of the hair without burning the scalp. This fine edge helps eliminate lines and creases that are caused by conventional flat irons. The fine edge can also be used to create volume in the hair of a user by allowing the user to lift hair from the roots.

Throughout this disclosure, unless the context dictates otherwise, the word "comprise" or variations such as "comprises" or "comprising," is understood to mean "includes, but is not limited to" such that other elements that are not explicitly mentioned may also be included. Further, unless the context dictates otherwise, use of the term "a" may mean a singular object or element, or it may mean a plurality, or one or more of such objects or elements.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Figure 1:
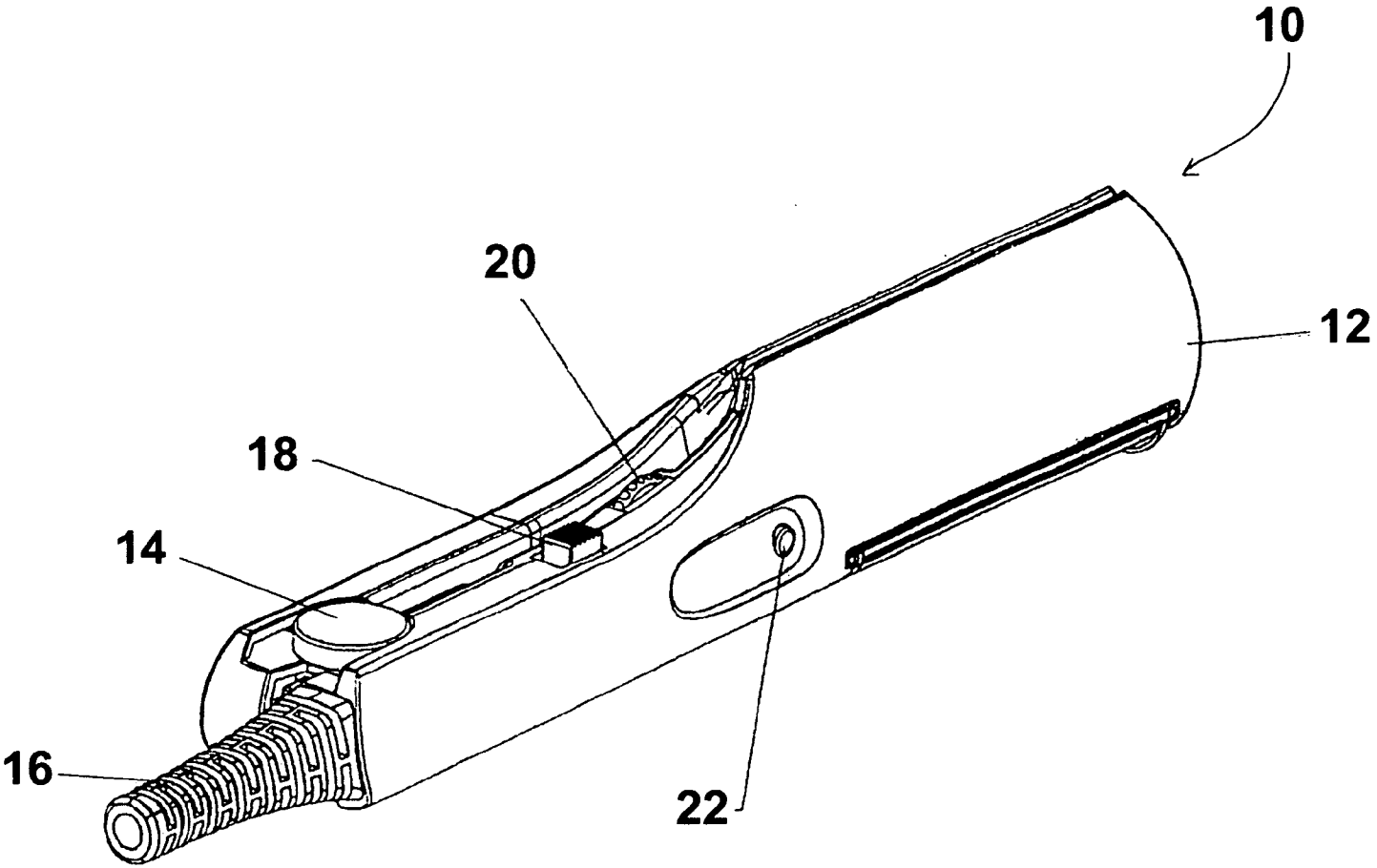
FIG. 1 is a perspective view of a preferred embodiment of a hair styling appliance.

A preferred embodiment of the present disclosure is a hair styling appliance 10 as shown in FIG. 1 that is useful for straightening and styling hair. As in conventional flat irons or flat straighteners, the appliance includes two blades 12 that are connected at one end by a hinge device 14 so the blades can open and close during use. As is typical, the appliance includes a spring device to bias the blades apart to aid in one hand operation of the device during styling of the hair. The appliance 10 also includes a flexible power cord connection 16 that is configured to accommodate a power cord to provide standard AC power to the appliance when the plug is inserted into an appropriate outlet. Further features of a preferred embodiment include a switch or actuator 18 to turn the appliance on or off, a potentiometer 20 to control the level of power supplied to heat the appliance and an indicator light 22 that either signals whether the device is on, or it may signal when the device has reached the effective temperature and is ready for use.

Figure 2:
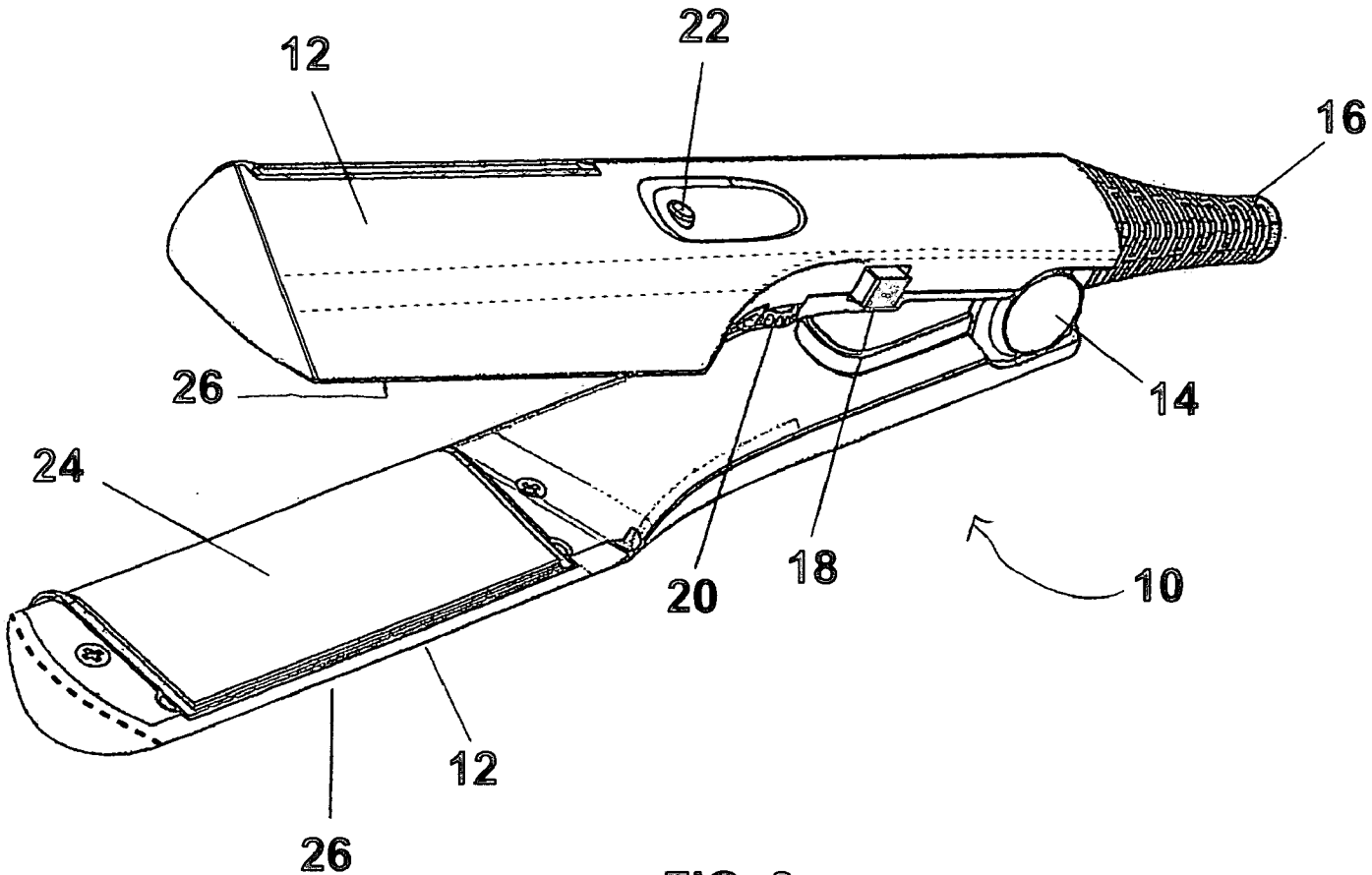
FIG. 2 is a perspective view of a preferred embodiment of a hair styling appliance in which the blades are separated.

FIG. 2 shows the appliance in a position with the blades open so that the styling plate 24 can be seen. As in conventional flat irons, the plates 24 are contacted by heating elements and when power is supplied to the heating elements, the temperature of the plates increases until the desired temperature is reached. The temperature can be controlled by a user through adjusting the potentiometer 20. Although it cannot be seen in the drawings, there is a mirror image heated plate on the top blade in FIG. 2 so that during use, a user places a lock or portion of hair between the blades and then closes the blades in order to press the hair between the two heated plates, and thus style the hair.

Figure 3:
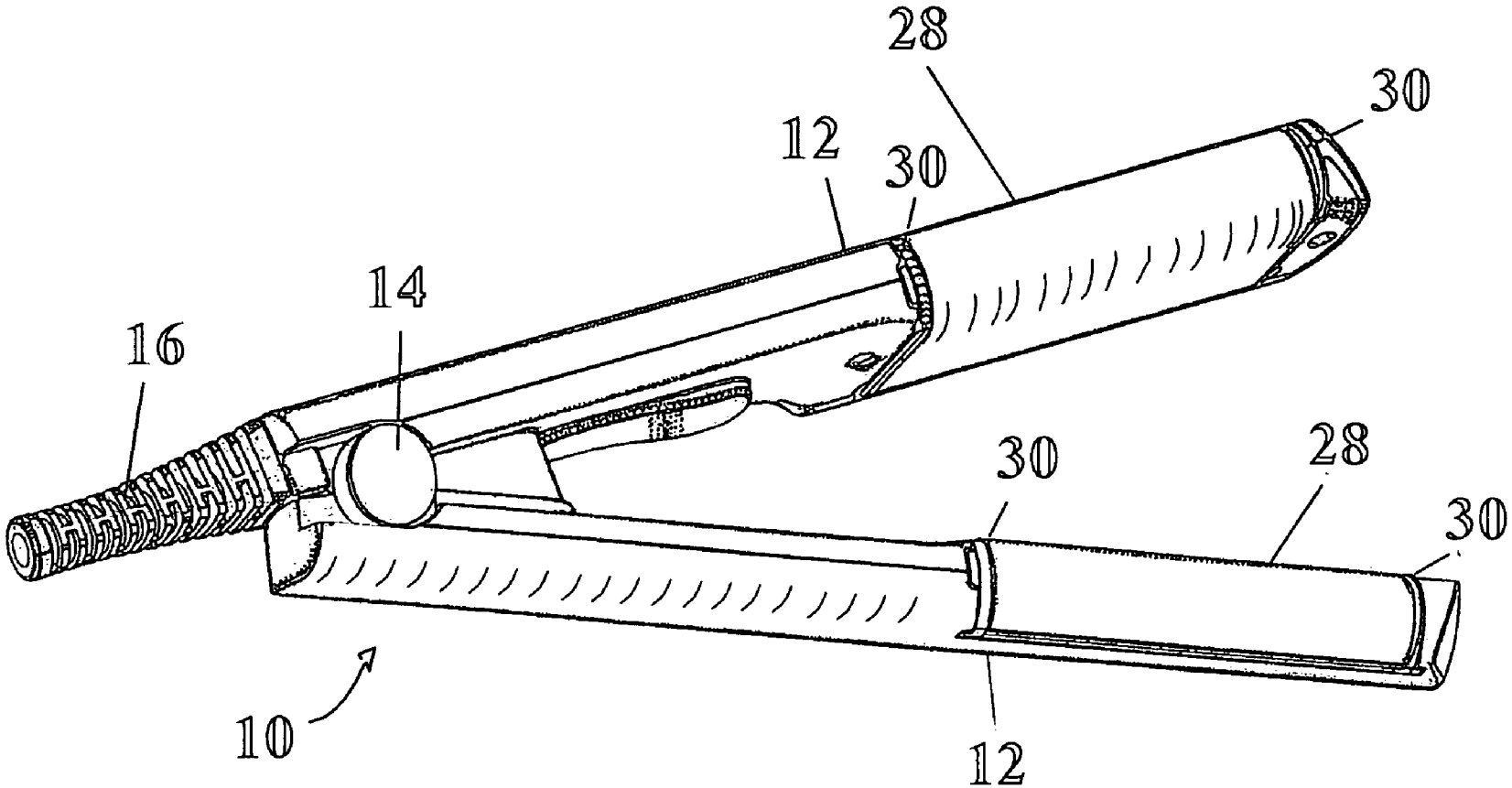
FIG. 3 is a alternate perspective view of a preferred embodiment of a hair styling appliance in which the blades are separated.
Figure 4:
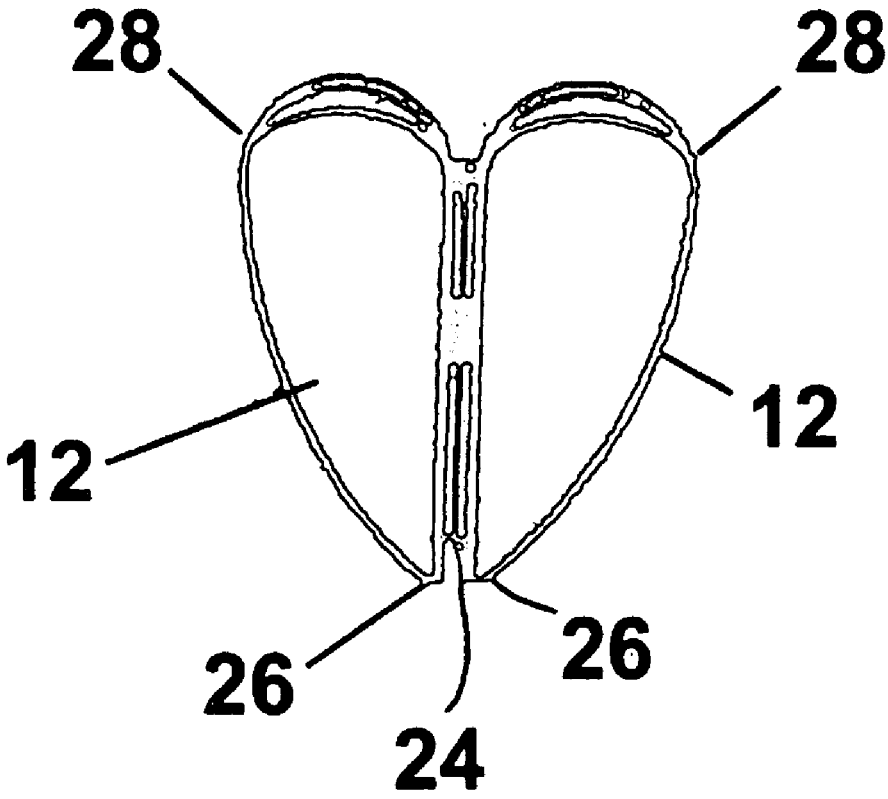
FIG. 4 is an elevational view of the end of a preferred embodiment of a hair styling appliance.

A feature of the preferred embodiment is the unique shape of the blades. This may best be seen in FIG. 4, which shows the end of the appliance furthest from the hinge, with the blades closed. The blades include a fine straight edge 26 as shown in FIG. 2, and the opposing sides 28 of the blades are curved or rounded as best seen in FIG. 3. The heated plates 24, which are planar in the interior of the blades curve around the rounded edge to give a rounded heated surface for curling or waving the hair. The blades further include projections or ridges 30 that project from the rounded side of the blade to protect a user's scalp from the heated surface. This configuration of the blades and heated plates provides advantages to a user in styling the hair in various styles. As is known in the art, the hair is often straightened first and then styled with a curve, wave, or flip style, for example. Using the appliance disclosed herein, a user can straighten a portion of the hair and then curl or flip that portion or a different portion using the same device. This saves the user the space and money of having to have two devices for styling the hair, and also saves the time of waiting for a second device to heat up to the proper temperature.

As described above, the fine edge allows the user to straighten the hair very close to the scalp without burning the skin, and also allows the user to lift the hair from the roots in order to create more volume. The rounded edge may then be used to style the ends of the hair when a curl of flip is desired.

While the apparatus and methods of this invention have been described in terms of preferred embodiments, it will be apparent to those of skill in the art that variations may be applied to the structures or methods described herein without departing from the concept, spirit and scope of the invention. All such similar substitutes and modifications apparent to those skilled in the art are deemed to be within the spirit, scope and concept of the invention as defined by the appended claims.

The invention claimed is:

1. An appliance for styling hair comprising:

a first blade and a second blade each having a proximal end and a distal end, wherein the first and second blades are connected by a hinge device near their proximal ends;

a spring device configured to bias the blades apart;

two heating plates, one attached to each blade near the distal end thereof, disposed so that when the blades are brought together the opposing plates are in contact with each other;

one or more heating elements connected to the heating plates effective to raise the temperature of the plates when power is supplied to the one or more heating elements;

a power cord connection configured to supply power from a power cord to the appliance;

wherein the blades each comprise a rounded edge and an opposing tapered edge and wherein each heating plate comprises a rounded edge that extends around the rounded edge of a blade and an opposed straight edge near the tapered edge of the blade, and wherein the blades form a narrowed edge on the side proximate the straight edges of the heating plates.

2. The appliance of claim 1, wherein the heating plates comprise metal, anodized, plated or coated metal, glass, ceramic or stone.

3. The appliance of claim 2, wherein the heating plates comprise aluminum or steel.

4. The appliance of claim 2, wherein the heating plates comprise jade.

5. The appliance of claim 1, further comprising an actuator switch to provide power to the one or more heating elements when the appliance is connected to a power source.

6. The appliance of claim 1, further comprising a potentiometer for adjusting the temperature of the heated plates.

7. The appliance of claim 5, further comprising an indicator light activated by the actuator switch.

* * * * *